United States Patent [19]

Nowack

[11] 4,298,341

[45] Nov. 3, 1981

[54] INDUSTRIAL OVEN HAVING AIR RECIRCULATING MEANS FOR MINIMIZING HEAT LOSS

[76] Inventor: William C. Nowack, Rte. 2, Box 256-2A, Lake Geneva, Wis. 53147

[21] Appl. No.: 132,495

[22] Filed: Mar. 21, 1980

[51] Int. Cl.[3] ..... F24F 9/00; F27D 7/00

[52] U.S. Cl. ..... 432/64; 98/36

[58] Field of Search ..... 432/64, 242; 34/242; 98/36

[56] References Cited

U.S. PATENT DOCUMENTS

| | | | |
|---|---|---|---|
| 1,725,059 | 8/1929 | Colby | 432/242 |
| 2,767,668 | 10/1956 | Spooner | 432/64 |
| 2,977,686 | 4/1961 | Stout | 98/36 |
| 3,157,105 | 11/1964 | Tamm et al. | 98/36 |
| 3,301,162 | 1/1967 | Zumbiel | 62/256 |
| 3,387,600 | 6/1968 | Terzian | 126/21 R |
| 3,502,020 | 3/1970 | Bressickello | 98/36 |
| 3,659,551 | 5/1972 | McKinstry | 98/36 |
| 3,698,205 | 10/1972 | Perez | 62/256 |
| 3,942,426 | 3/1976 | Binks et al. | 62/256 |

*Primary Examiner*—John J. Camby

*Attorney, Agent, or Firm*—Burmeister, York, Palmatier, Hamby & Jones

[57] ABSTRACT

An industrial oven in which articles to be heat treated are carried by a conveyor through a heated tunnel space in a tunnel structure which has end walls with access openings, such oven comprising a nozzle directed downwardly into the tunnel space at an inclined angle across at least one access opening, an exhaust opening communicating with the tunnel space in the vicinity of the upper portion of such access opening, and air handling means for withdrawing hot air from the tunnel space through said exhaust opening while blowing hot air into the tunnel space through said nozzle for minimizing the escape of hot air through such access opening. The air handling means may take the form of a recirculating blower connected between the exhaust opening and the nozzle. The oven may have an air heating and recirculating system which withdraws air from the tunnel space. Instead of providing a separate recirculating blower, exhaust and supply ducts may be connected to the intake and discharge sides of such system and may extend to the exhaust opening and the nozzle to circulate hot air out of the tunnel space through the exhaust opening and into the tunnel space through the nozzle.

17 Claims, 6 Drawing Figures

10
22
14
44
18
42
92
52
54
48
46
56
90
92
90
50
50
88
66
26
64
62
60
80
12
30
32
28
33
36
16
20
32
30
34
33
26
24

INDUSTRIAL OVEN HAVING AIR RECIRCULATING MEANS FOR MINIMIZING HEAT LOSS

This invention relates to a new and improved industrial oven having means for recirculating air to produce a hot air curtain for effectively minimizing the loss of hot air through one or both of the access openings through which the articles to be heat treated are conveyed into and out of the oven.

Typically, a mechanical conveyor is employed to carry a continuous series of the articles to be heat treated into the oven through one access opening, through the tunnel space in the oven, and out of the oven through another access opening. Some of the hot air in the oven tends to escape through the access openings, which must be kept continuously open. The escape of the hot air causes wastage of energy. Moreover, the interior of the oven is cooler near the access openings than in the central portion of the oven. Furthermore, the escaping hot air raises the room temperature outside the oven, in the vicinity of the access openings, so that uncomfortably hot working conditions may be produced in the room.

One object of the present invention is to provide an industrial oven having new and improved means for minimizing the escape of hot air from the oven through the conveyor access openings, so as to minimize the wastage of energy, while also reducing the ambient temperature in the room outside the oven and improving the uniformity of the high temperature within the oven.

A further object is to provide a new and improved heat retention system which is readily applicable to both new and existing industrial ovens, at low cost.

These and other objects of the present invention can be achieved by providing an industrial oven for heat treating a series of articles, such oven comprising a tunnel enclosure having a tunnel space therein through which the articles to be heat treated may pass, the tunnel enclosure having side walls and upper and lower walls, the side walls including terminal walls having access openings through which the articles to be heat treated may pass into and out of the tunnel space, conveyor means for carrying the articles through the access openings and the tunnel space, heating means for supplying heat to the tunnel space to heat treat the articles, a nozzle communicating with the tunnel space near the upper wall and near one terminal wall for directing a stream of hot air downwardly across the corresponding access opening in such terminal wall, the nozzle being angled downwardly into the tunnel space and away from the corresponding access opening to resist the escape of hot air from the tunnel space through the access opening, an exhaust structure having an exhaust opening communicating with the tunnel space in the vicinity of the nozzle to provide for the lowering of the air pressure in the tunnel space near the upper portion of the corresponding access opening, and air handling means for withdrawing hot air from the tunnel space through the exhaust opening while blowing hot air into the tunnel space through the nozzle for minimizing the escape of hot air from the tunnel space through the corresponding access opening. The nozzle is preferably aimed downwardly into the tunnel space and away from the access opening at an inclined angle which is less than 90° to the horizontal. Such inclined angle is preferably in the range from 45° to 85° with reference to the horizontal, and preferably is approximately 65°.

The air handling means may comprise a circulating blower connected between the exhaust opening and the nozzle for withdrawing hot air from the tunnel space through the exhaust opening and for blowing the hot air into the tunnel space through the nozzle.

The heating means may include an air heating and circulating system for drawing air from the tunnel space, heating such air and discharging the heated air into the tunnel space. As an alternative to a separate blower, the air handling means may comprise an exhaust duct connected between the exhaust opening and the intake side of the air heating and circulating system, and a supply duct connected between the nozzle and the discharge side of such system, for withdrawing air through the exhaust opening while supplying heated air to the nozzle.

Further objects, advantages and features of the present invention will appear from the following description, taken with the accompanying drawings, in which.

Figure 2:
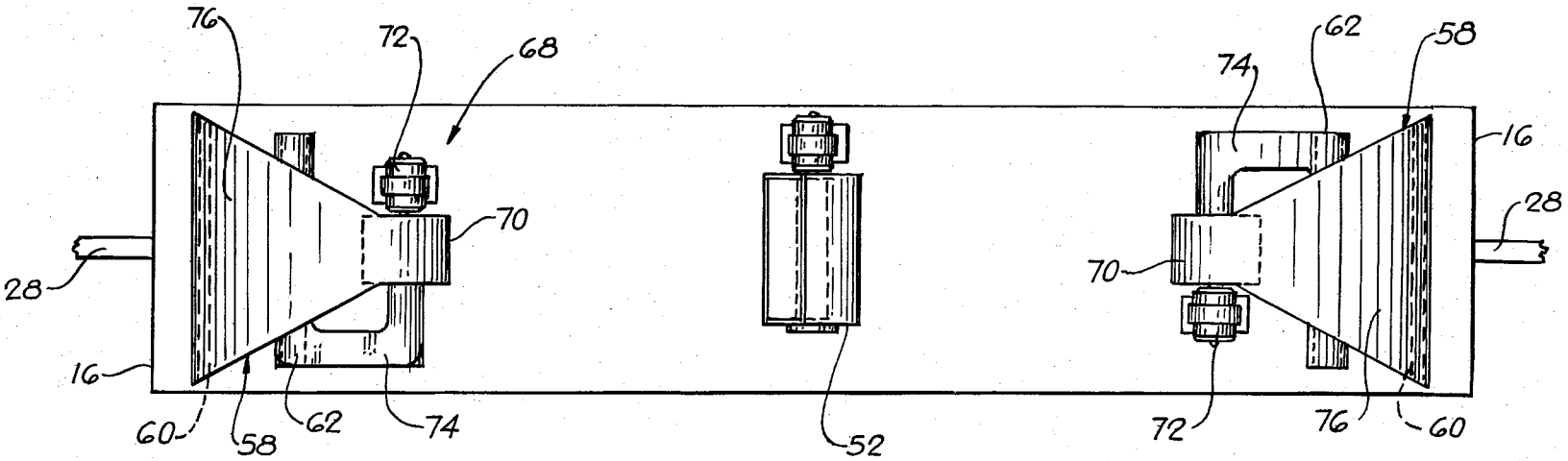
FIG. 2 is a diagrammatic plan view of the industrial oven.
Figure 1:
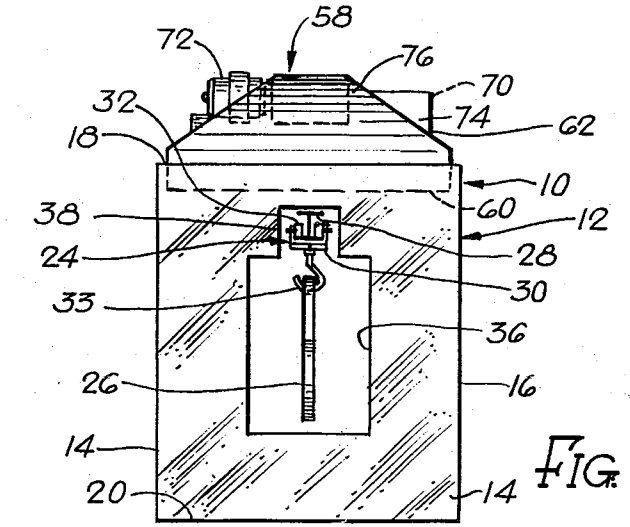
FIG. 1 is a diagrammatic end view of an industrial oven to be described as an illustrative embodiment of the present invention.
Figure 3:
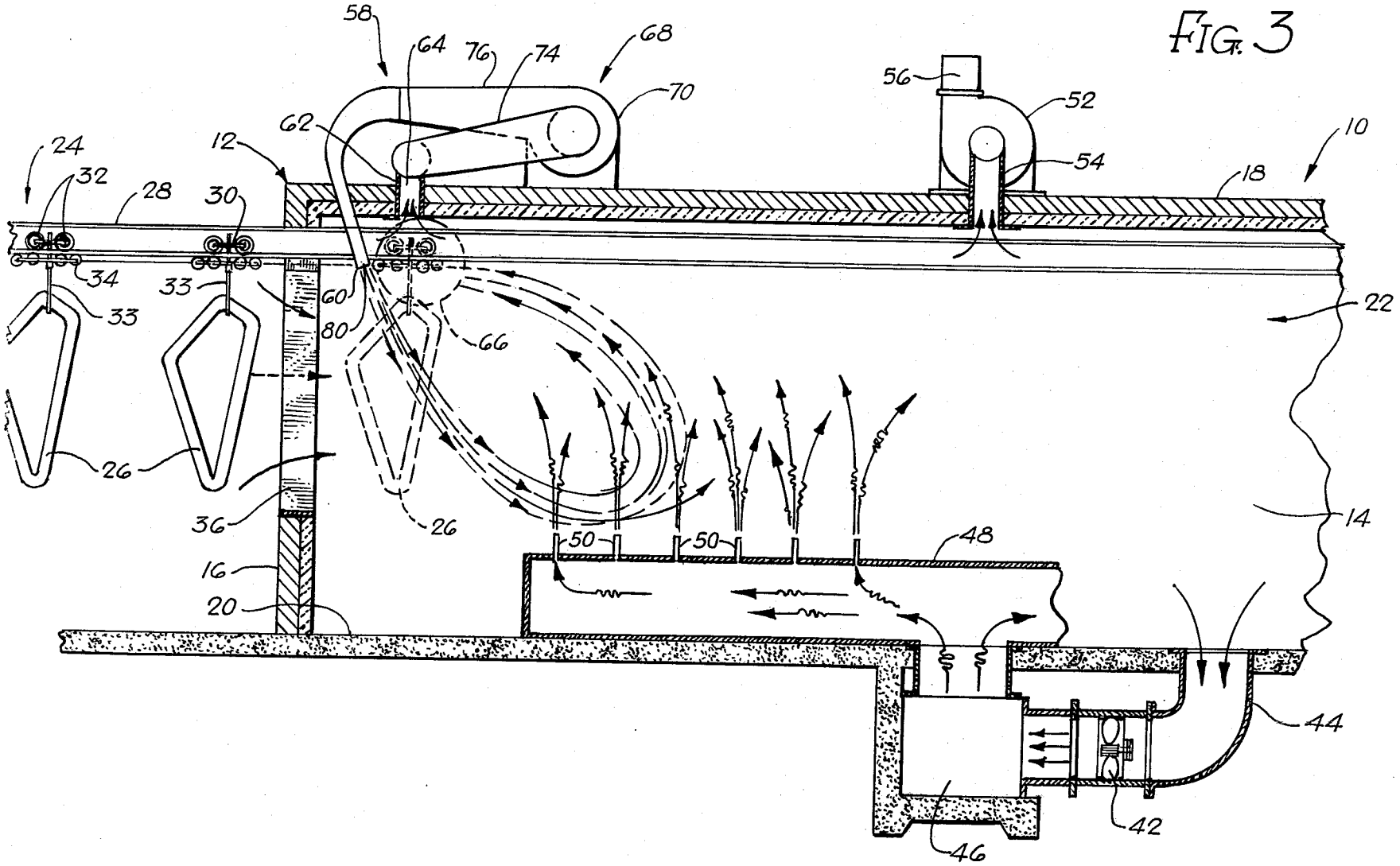
FIG. 3 is a fragmentary diagrammatic longitudinal section, taken through the industrial oven of FIGS. 1 and 2.

As just indicated, FIGS. 1–4 illustrate an illustrative embodiment of the present invention, in the form of an industrial oven 10 comprising a tunnel enclosure 12 having a pair of longitudinal side walls 14, a pair of end or terminal side walls 16, an upper wall 18, and a lower wall or floor 20. A heated tunnel space 22 is provided within the tunnel enclosure 12, as shown in FIG. 3.

Typically, a conveyor 24 is employed to carry a continuous series of articles 26 through the tunnel space 22 in the oven 10. In this way, the articles 26 are baked or otherwise heat treated by the heat in the oven 10. For example, the oven 10 may be employed to bake paint which has been applied to the articles 26.

The illustrated conveyor 20 comprises a longitudinal rail 28 extending through the tunnel space 22 of the tunnel 10. The rail 28 is adapted to support a continuous series of carriages 30 having rollers 32 adapted to travel along the rail 28. Each carriage 30 includes a hanger 33 for supporting one of the articles 26 to be heat treated. A continuous conveyor chain 34 may be employed to advance the carriages 30 along the rail 28. It will be understood that the conveyor 24 includes suitable driving means, not shown, for advancing the conveyor chain 34.

Each of the end walls of the oven 10 is formed with a conveyor access opening 36, through which the articles 26 to be heat treated are carried by the conveyor 24. The upper portion of each access opening 36 is in the form of a slot 38 through which the conveyor rail 28 extends. Each access opening 36, including the slot portion 38, is kept open at all times to accommodate the movement of the articles 26 and the conveyor carriages 30 through the openings 36. The present invention deals with the problem of minimizing the escape of hot air from the oven 10 through the conveyor access openings 36.

As shown in FIG. 3, the tunnel space 22 within the oven 10 may be heated by the heating system 40 which recirculates and heats the air in the tunnel space 22. As shown, the heating system 40 comprises a main oven fan or blower 42 which draws air from the tunnel space 22 through a return duct 44. The fan 42 then blows the air through a furnace or heat exchanger 46, which heats the air. The hot air from the furnace 46 is discharged into an oven duct 48 which distributes the hot air throughout the oven 10 and discharges the hot air through a plurality of nozzles or openings 50, into the tunnel space 22 within the oven 10.

Typically, an oven exhaust fan 52 is provided for exhausting waste gases, vapors and smoke from the tunnel space 22 in the oven 10, preferably through the upper wall 18. Some of the hot air in the tunnel space 22 is also exhausted by the oven exhaust fan 52. The intake side of the oven exhaust fan 52 is connected to the upper portion of the tunnel space 22 by an exhaust duct 54. The discharge side of the fan 52 may be connected to a discharge duct 56, leading to the atmosphere through a suitable pollution control system, not shown.

The oven exhaust fan 52 reduces the pressure within the tunnel space 22 in the oven 10, with the result that the fan 52 effectively draws outside air into the tunnel space 22 through the conveyor access openings 36. Such outside air replaces the air and the waste products discharged by the oven exhaust fan 52.

It has been found that, in the absence of the present invention, there is a significant loss of hot air from the oven 10 through the conveyor access openings 36, particularly through the upper portions of such openings. This loss of hot air results in a cooling of the tunnel space 22 within the oven 10 in the vicinity of the conveyor access openings 36. Moreover, the hot air, spilling out of the oven 10 through the openings 36, produces a significant heating of the room, so that uncomfortably hot working conditions can result in the vicinity of the openings 36. Of course, the loss of hot air from the oven 10 represents a waste of energy.

The present invention provides heat retention means 58 for reducing and minimizing the loss of hot air through the conveyor access openings 36. As indicated in FIG. 2, such heat retention means 58 may be provided at both ends of the oven 10, in connection with both of the conveyor access openings 36. The details of the heat retention means 58 are shown in FIG. 3 in connection with one of the access openings 36. The heat retention means 58 may be the same at the opposite end of the oven 10.

As shown in FIG. 3, the heat retention means 58 may comprise a nozzle 60 communicating with the tunnel space 22 in the oven 10 near the upper wall 18 and near the terminal wall 16, in which the conveyor access opening 36 is provided. The nozzle 60 is adapted to direct a stream of hot air downwardly within the oven, across the opening 36. The nozzle 60 is angled downwardly into the tunnel space 22 and away from the access opening 36 to resist the escape of hot air from the tunnel space 22 through the opening 36.

The heat retention means 58 may also include an exhaust structure 62 which provides an exhaust opening 64 communicating with the tunnel space 22 in the vicinity of the nozzle 60 to provide for the lowering of the air pressure in the tunnel space 22 near the upper portion of the access opening 36. In FIG. 3, the region of relatively low pressure is indicated in broken lines at 66.

The heat retention means 58 may also include air handling means 68 for withdrawing hot air from the tunnel space 22 through the exhaust opening 64 while blowing hot air into the tunnel space through the nozzle 60. The stream of hot air from the nozzle 60 travels downwardly across the inner side of the opening 36 and angles away from the opening 36 and into the tunnel space 22. Such stream of air tends to be reflected upwardly by the oven duct 48 and the floor 20, as indicated by the arrows in FIG. 3, so that a considerable portion of the air stream tends to return to the exhaust opening 64.

In the embodiment of FIG. 3, the air handling means 68 may comprise a separate recirculating blower or fan 70, driven by a motor 72. The intake side of the blower 70 is connected by a duct 74 to the exhaust opening 64, while the discharge side of the blower 70 is connected by a duct 76 to the nozzle 60. The downwardly inclined air stream from the nozzle 60 and the withdrawal of air through the exhaust opening 64 have the combined effect of substantially reducing and minimizing the loss of hot air through the adjacent access opening 36. As shown in FIG. 3, the nozzle 60 is quite close to the upper portion of the access opening 36 and is located between the opening 36 and the exhaust opening 64. The nozzle 60 is aimed downwardly into the tunnel space 22 and away from the access opening 36 at an inclined angle which is less than 90° to the horizontal. For satisfactory results, it is believed that the inclined angle of the nozzle 60 should be in the range from 45° to 85° with reference to the horizontal. An inclined angle of approximately 65° to the horizontal has been found to be particularly advantageous and effective in reducing the loss of hot air from the oven 10 through the conveyor access opening 36.

Figure 4:
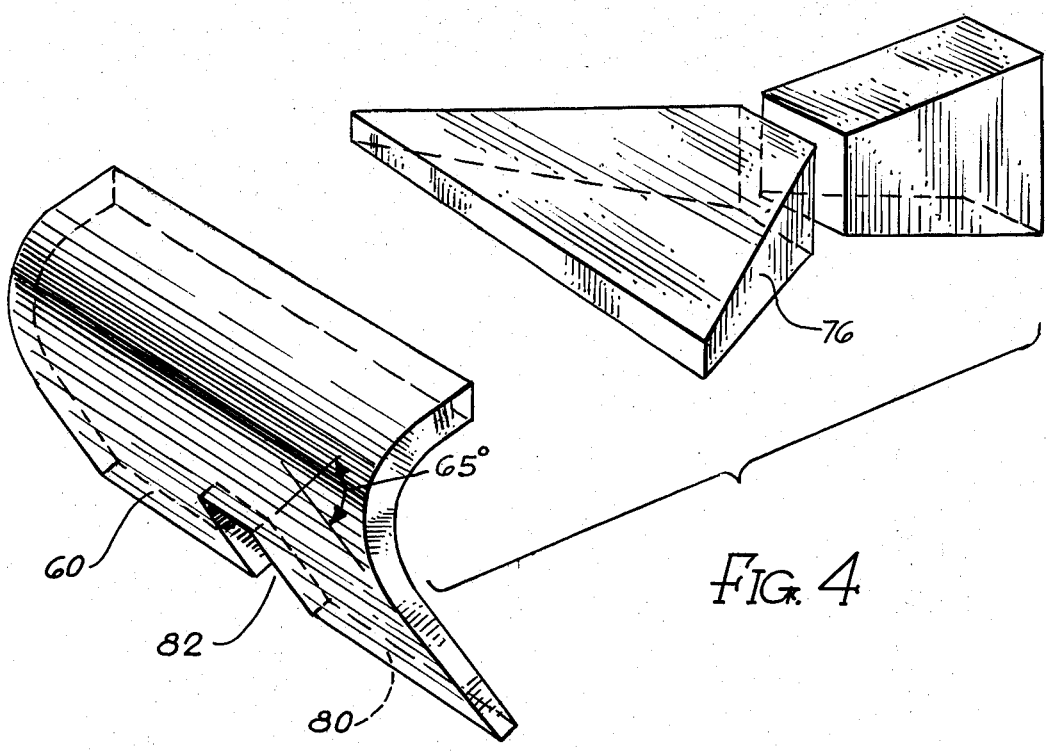
FIG. 4 is an exploded perspective view of a nozzle construction for the oven of FIGS. 1–3.

The nozzle 60 preferably has a discharge opening 80 which is generally in the form of a narrow rectangle to produce a flat stream of air having a width corresponding generally to the width of the access opening 36. As shown in FIG. 3, the nozzle 60 extends downwardly below the level of the conveyor rail 28. It will be seen from FIG. 4 that the nozzle 60 is formed with a notch 82 to afford clearance for the conveyor rail 28. FIG. 4 also shows the manner in which the duct 76 is flared to join with the nozzle 60.

The stream of air from the nozzle 60 should have a relatively low velocity so that the air stream will not unduly disturb the articles 26 which are carried on the hangers 32 of the conveyor 24. If the velocity of the air stream is excessive, the air stream may tend to blow some of the articles 26 off the hangers 33. It has been found that a low velocity air stream is effective to minimize the loss of hot air through the conveyor access openings 36.

The desirable velocity of the air stream depends upon the height of the conveyor access opening 36, across which the air stream is to travel. It has been found that good results are achieved by an air stream velocity which is 900 feet per minute for each foot of height of the opening 36. Thus, for an access opening 36 having a height of 5 feet, the air velocity should be 4500 ft/min., pursuant to this formula.

It has been found that good results are achieved with a nozzle 60 having an aperture width of 1 inch, when the height of the conveyor opening 36 is 5 feet or less. When the height of the conveyor opening 36 is greater than 5 feet, it is preferable to employ a nozzle 60 having an aperture width of 2 inches, to produce an air stream having an initial thickness of 2 inches.

Figure 5:
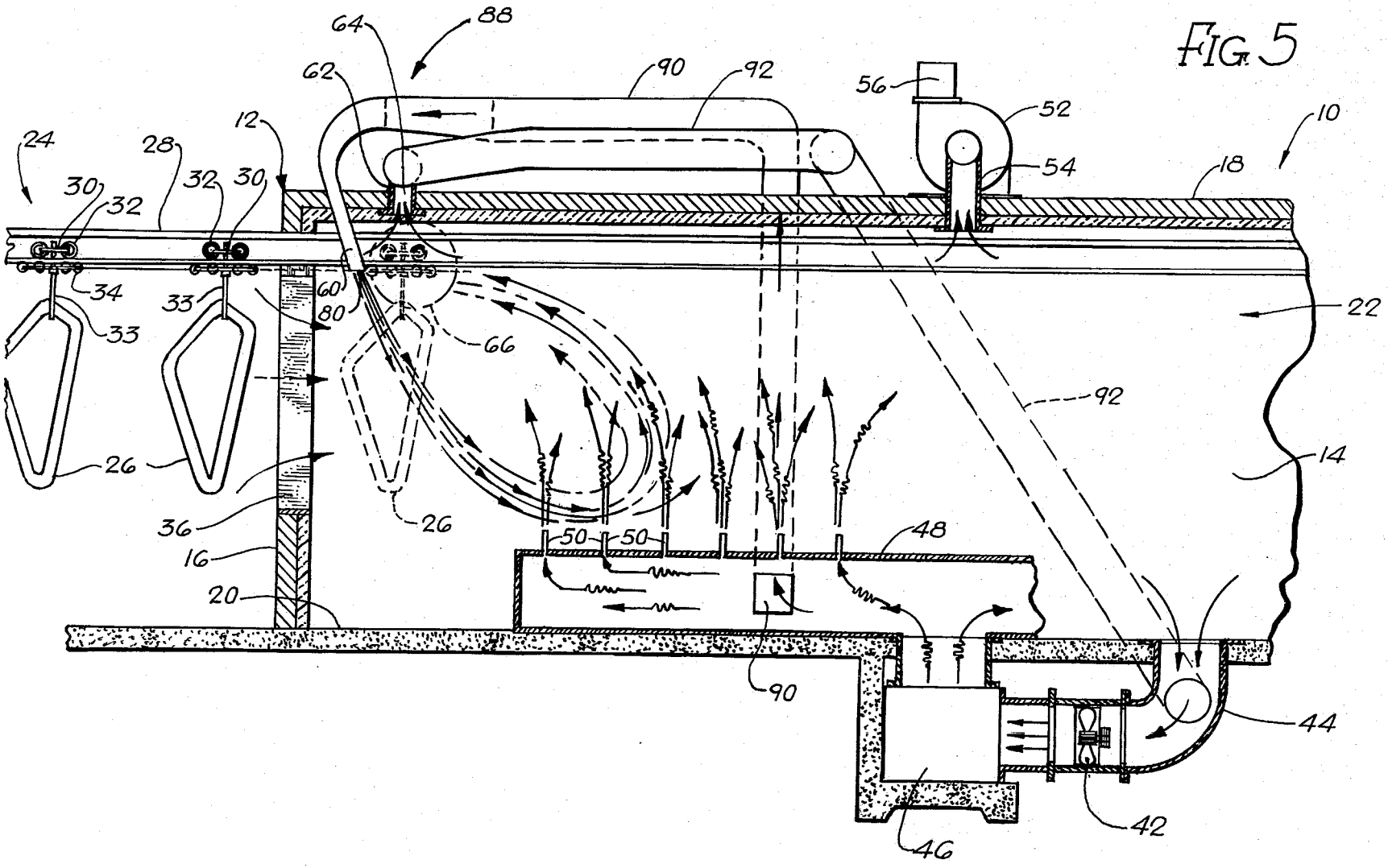
FIG. 5 is a fragmentary diagrammatic longitudinal section, similar to FIG. 3, but showing a modified construction.

FIG. 5 illustrates the fact that it is not always necessary to provide a separate blower to circulate hot air out of the nozzle 60 and into the exhaust opening 64. The modified embodiment of FIG. 5 has modified heat retention means 88, whereby the main heating system 40 of the oven 10 produces a circulation of the hot air out of the nozzle 60 and into the exhaust opening. As shown, hot air is supplied to the nozzle by a duct 90 connected between the nozzle 60 and the main oven duct 48 which receives hot air from the discharge side of the heat exchanger or furnace 46. The circulation of the hot air is produced by the main oven fan 42.

In FIG. 5, a return duct 92 is connected between the exhaust opening 64 and the main return duct 44 of the oven heating system 40. Thus, the main oven fan 42 is effective to draw hot air into the exhaust opening 64. In the modified embodiment of FIG. 5, the main oven heating system 40 must be capable of circulating the additional hot air which must be discharged from the nozzle 60 and drawn into the exhaust opening 64. In the embodiment of FIG. 5, the velocity of the air stream from the nozzle 60 should be approximately the same as in the case of the embodiment of FIG. 3, as previously discussed.

Figure 6:
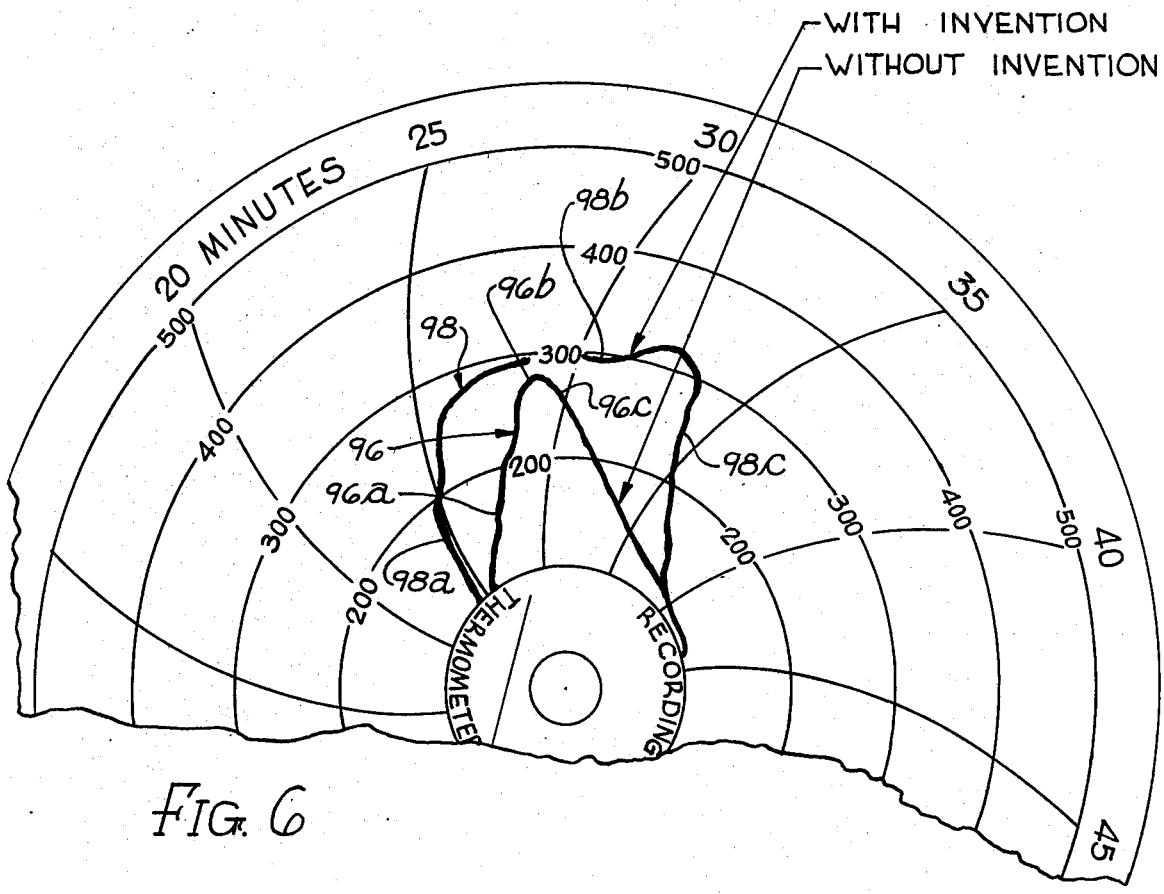
FIG. 6 is a temperature chart showing the variation of the oven temperature along the length of the oven, with and without the present invention.

FIG. 6 is a reproduction of two temperature charts 96 and 98, produced by a recording thermometer, showing the variation of the temperature along the length of the tunnel space 22 in the oven 10. Each of these charts was made by mounting a temperature sensor on one of the conveyor hangers 22, so that the temperature sensor was carried through the oven 10 along the length thereof. The recording thermometer then produced a chart showing the temperature as a function of time.

The temperature chart 96 was produced without the present invention, while the temperature chart 98 was produced with the present invention. It will be seen that the chart 96 shows a considerable variation in the temperature along the length of the oven 10. Following entry of the temperature sensor into the oven 10 through one of the access openings 36, the chart 96 shows a gradual upward slope 96*a*, representing a temperature rise in the oven near the first access opening 36, a temperature peak 96*b* in the central portion of the oven 10, and a gradual downward slope 96*c*, representing a decreasing temperature near the exit opening 36.

The second temperature chart 98, representing the temperature variation with the use of the present invention, shows a much steeper temperature rise 98*a*, a broad temperature plateau 98*b*, and a steep downward slope 98*c*, representing the rapid drop in the temperature at the access opening 36. The broad temperature plateau 98*b* indicates that the temperature in the oven 10 is uniformly high for much of the length of the oven. The plateau 98*b* rises to a somewhat higher temperature than the peak 96*b*, thus indicating a greater retention of heat in the oven.

It thus clearly appears that the present invention results in a somewhat higher temperature within the oven and significantly improved temperature uniformity along the length of the oven.

The heat retention means of FIGS. 2 and 3, or the alternate means 88 of FIG. 5, may be provided at either or both end walls 16, to minimize the loss of heat through either or both access openings 36. There is a particular advantage in providing the heat retention means at both ends of the oven, in that the downwardly inclined streams of air from the nozzles 60 at both ends of the oven travel in opposite directions along the length of the oven toward the central portion of the oven, where the oppositely directed streams impinge upon each other and neutralize each other, so that neither stream travels to the far end of the oven. Thus, there is no tendency for either stream of air to produce an outward current of air at the far end of the oven.

As previously indicated, the stream of hot air from each nozzle 60 is deflected upwardly and also in a retrograde direction by the oven duct 48, which thus acts as baffle means to prevent the air stream from travelling any great distance along the length of the oven 10. If some other heating arrangement is used, not involving the oven duct 48, separate baffle means may be provided to deflect the air stream from the nozzle 60, so as to break up the longitudinal flow of the air toward the far end of the oven.

It will be evident that the present invention minimizes the escape of hot air from the oven through the conveyor access openings, so as to reduce the wastage of energy, while also improving the uniformity of the high temperature within the oven along its length. The present invention also minimizes the heating of the room by the oven, particularly in the regions near the conveyor access openings in the oven walls.

The present invention effectively minimizes the escape of smoke and other waste products from the oven through the conveyor access openings, as well as minimizing the escape of hot air. Because of the reduced loss of hot air from the oven, it is possible to install the oven in a smaller room, without causing excessively hot conditions in the room around the oven.

The stream of air from the nozzle 60 spreads laterally and scrubs along the sidewalls 14 of the oven, thus effectively blocking the entire width of the oven, against the escape of hot air. The present invention may be used with ovens of all sizes, and with conveyor access openings of all sizes in the walls of industrial ovens.

The nozzle 60 preferably projects downwardly, substantially below the level of the exhaust opening 64. With this construction, the low pressure zone produced by the exhaust opening 64 does not cause any significant deflection of the air stream from the nozzle 60.

The exhaust opening 64 and the nozzle 60 should be quite close to the access opening 36 in the end wall 16. If the exhaust opening 64 is moved farther away from the nozzle 60, the exhaust opening tends to produce a greater bending of the air stream from the nozzle 60.

In the illustrated oven 10, the conveyor 24 carries the articles 26 along a straight path through the oven. However, the present invention may also be employed very effectively in connection with an oven in which the conveyor carries the articles along a winding or serpentine path. The present invention is still very effective to minimize the escape of hot air through the conveyor access opening or openings.

I claim:

1. An industrial oven for heat treating a series of articles, comprising a tunnel enclosure having a tunnel space therein through which the articles to be heat treated may pass, said tunnel enclosure having upper and lower walls and side walls, said side walls including a terminal wall having an access opening through which the articles to be heat treated may pass, conveyor means for carrying the articles through said access opening and said tunnel space, heating means for supplying heat to said tunnel space to heat treat the articles, a nozzle disposed within said tunnel enclosure near said upper wall and near said terminal wall for directing a stream of hot air downwardly across the access opening, said nozzle being angled downwardly into said tunnel space and away from said access opening to resist the escape of hot air from said tunnel space through said access opening, an exhaust structure having an exhaust opening disposed within said tunnel enclosure at the upper wall thereof on the side of said nozzle opposite the access opening to provide for the lowering of the air pressure in said tunnel space near the upper wall on the side of the nozzle remote from said access opening, and air handling means for withdrawing hot air from said tunnel space through said exhaust opening while blowing hot air into said tunnel space through said nozzle for minimizing the escape of hot air from said tunnel space through said access opening.

2. An industrial oven according to claim 1, in which said nozzle is aimed downwardly into said tunnel space and away from said access opening at an inclined angle which is less than 90 degrees to the horizontal.

3. An industrial oven according to claim 1, in which said nozzle is aimed downwardly into said tunnel space and away from said access opening at an inclined angle in the range from 45 degrees to 85 degrees with reference to the horizontal.

4. An industrial oven according to claim 1, in which said nozzle is aimed downwardly into said tunnel space and away from the access opening at an inclined angle of approximately 65 degrees to the horizontal.

5. An industrial oven according to claim 1, in which said air handling means comprise a circulating blower connected between said exhaust opening and said nozzle for withdrawing hot air from said tunnel space through said exhaust opening and for blowing the hot air into said tunnel space through said nozzle.

6. An industrial oven according to claim 1, in which said heating means include an air heating and circulating system for drawing air from said tunnel space, heating said air and discharging the heated air into said tunnel space, said air handling means comprising an exhaust duct connected between said exhaust opening and the intake side of said air heating and circulating system, and a supply duct connected between said nozzle and the discharge side of said air heating and circulating system, for withdrawing air through said exhaust opening while supplying heated air to said nozzle.

7. An industrial oven according to claim 1, in which said nozzle and said air handling means provide a stream of air through said nozzle at a velocity of approximately 900 feet per minute for each foot in the height of said access opening.

8. An industrial oven according to claim 1, in which said nozzle and said exhaust opening are closely adjacent the upper portion of the corresponding access opening, said nozzle being located between said exhaust opening and the access opening.

9. An industrial oven according to claim 1, in which said nozzle and said exhaust opening are closely adjacent the upper portion of the access opening, said nozzle extending downwardly to a lower elevation than the elevation of said exhaust opening.

10. An industrial oven according to claim 1, in which said nozzle and said exhaust opening are closely adjacent the upper portion of the access opening, said nozzle being disposed between said exhaust opening and said access opening, said nozzle extending downwardly to a lower elevation than the elevation of said exhaust opening.

11. In an industrial oven for heat treating a series of articles and comprising a tunnel enclosure having a tunnel space therein through which the articles to be heat treated may pass, said tunnel enclosure having sidewalls and upper and lower walls, said sidewalls including terminal walls having access openings through which the articles to be heat treated may pass into and out of said tunnel space, conveyor means for carrying the articles through said access openings and said tunnel space, heating means for supplying heat to said tunnel space to heat treat the articles, the improvement in that each of said terminal walls is provided with a nozzle disposed within the tunnel enclosure adjacent to the upper wall and said corresponding terminal wall and communicating with said tunnel space for directing a stream of hot air downwardly across the corresponding access opening in the corresponding terminal wall, said nozzle being angled downwardly into said tunnel space and away from the corresponding access opening to resist the escape of hot air from said tunnel space through such access opening, an exhaust structure having an exhaust opening disposed in the upper wall of said tunnel enclosure adjacent to and interior of said nozzle to provide for the lowering of the air pressure in said tunnel space near the upper portion of the corresponding access opening, and air handling means for withdrawing hot air from said tunnel space through said exhaust opening while blowing hot air into said tunnel space through said nozzle for minimizing the escape of hot air from said tunnel space through the corresponding access opening.

12. In an industrial oven according to claim 11, each nozzle being aimed downwardly into said tunnel space and away from the corresponding access opening at an inclined angle which is less than 90 degrees to the horizontal.

13. In an industrial oven according to claim 11, each nozzle being aimed downwardly into said tunnel space and away from the corresponding access opening at an inclined angle of approximately 65 degrees to the horizontal.

14. In an industrial oven according to claim 11, each air handling means comprising a circulating blower connected between the corresponding exhaust opening and the corresponding nozzle for withdrawing hot air from said tunnel space through said exhaust opening and for blowing the hot air into said tunnel space through said nozzle.

15. In an industrial oven according to claim 11, said heating means including an air heating and circulating system for drawing air from said tunnel space, heating said air and discharging the heated air into said tunnel space;

each air handling means comprising an exhaust duct connected between the corresponding exhaust opening and the intake side of said air heating and circulating system, and a supply duct connected between the corresponding nozzle and the discharge side of said system, for withdrawing air through said exhaust opening while supplying heated air to said nozzle.

16. In an industrial oven according to claim 11, including baffle means for intercepting and deflecting the stream of hot air from each nozzle.

17. In an industrial oven according to claim 11, each nozzle and the corresponding air handling means producing a stream of air at said nozzle having a velocity of approximately 900 feet per minute for each foot in the height of the corresponding access opening.

* * * * *